US006956019B2

(12) United States Patent
Lentsch et al.

(10) Patent No.: US 6,956,019 B2
(45) **Date of Patent: *Oct. 18, 2005**

(54) COMBINATION OF A NONIONIC SILICONE SURFACTANT AND A NONIONIC SURFACTANT IN A SOLID BLOCK DETERGENT

(75) Inventors: Steven E. Lentsch, St. Paul, MN (US); Victor F. Man, St. Paul, MN (US); Deborah A. Ihns, St. Paul, MN (US); Helmut K. Maier, Golden Valley, MN (US); Rhonda K. Schulz, Eagan, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/894,818

(22) Filed: Jul. 19, 2004

(65) Prior Publication Data

US 2004/0254090 A1 Dec. 16, 2004

Related U.S. Application Data

(63) Continuation of application No. 10/696,317, filed on Oct. 28, 2003, now Pat. No. 6,767,884, which is a continuation of application No. 09/715,638, filed on Nov. 17, 2000, now Pat. No. 6,664,219, which is a continuation of application No. 09/228,633, filed on Jan. 11, 1999, now Pat. No. 6,164,296, which is a division of application No. 08/782,336, filed on Jan. 13, 1997, now Pat. No. 6,489,278, which is a continuation-in-part of application No. 08/441,252, filed on May 15, 1995, now abandoned, which is a continuation-in-part of application No. 08/176,541, filed on Dec. 30, 1993, now abandoned.

(51) Int. Cl.[7] ..... C11D 17/00; C11D 17/06; C11D 1/66; C11D 3/10; C11D 3/36

(52) U.S. Cl. ..... 510/445; 510/218; 510/220; 510/224; 510/225; 510/228; 510/400; 510/466; 510/469; 510/480; 510/509

(58) Field of Search ..... 510/218, 220, 510/224, 225, 228, 400, 445, 466, 469, 480, 509

(56) References Cited

U.S. PATENT DOCUMENTS

| | | | |
|---|---|---|---|
| 2,164,092 | A | 6/1939 | Smith |
| 2,382,163 | A | 8/1945 | MacMahon |
| 2,559,583 | A | 7/1951 | Barker |
| 2,559,584 | A | 7/1951 | Barker |
| 2,561,392 | A | 7/1951 | Marshall |
| 2,584,056 | A | 1/1952 | Soule et al. |
| 2,584,057 | A | 1/1952 | Soule et al. |
| 2,665,256 | A | 1/1954 | Barker |
| 2,824,091 | A | 2/1958 | Desty et al. |
| 3,046,232 | A | 7/1962 | Bonewitz |
| 3,066,354 | A | 12/1962 | Chaffee et al. |
| 3,233,986 | A | 2/1966 | Morehouse |
| 3,342,740 | A | 9/1967 | Kazmierczak et al. |
| 3,366,571 | A | 1/1968 | Cooper et al. |
| 3,324,038 | A | 6/1967 | Chaffee et al. |
| 3,398,219 | A | 8/1968 | Kelly et al. |
| 3,554,915 | A | 1/1971 | Keay et al. |
| 3,741,913 | A | 6/1973 | Stenungsund |
| 3,746,653 | A | 7/1973 | Churchfield |
| 3,803,285 | A | 4/1974 | Jensen |
| 3,858,854 | A | 1/1975 | Win et al. |
| 3,957,661 | A | 5/1976 | Verite |
| 3,962,119 | A | 6/1976 | Cosentino et al. |
| 4,105,573 | A | 8/1978 | Jacobsen |
| 4,119,578 | A | 10/1978 | Daeninckx et al. |
| 4,136,045 | A | 1/1979 | Gault et al. |
| 4,203,857 | A | 5/1980 | Dugan |
| 4,219,435 | A | 8/1980 | Biard et al. |
| 4,219,436 | A | 8/1980 | Gromer et al. |
| 4,242,217 | A | 12/1980 | Westermann et al. |
| 4,265,777 | A | 5/1981 | Boyer et al. |
| 4,289,525 | A | 9/1981 | Pasarela et al. |
| 4,370,250 | A | 1/1983 | Joshi |
| 4,427,558 | A | 1/1984 | David |
| 4,510,110 | A | 4/1985 | Mazzoni |
| 4,517,107 | A | 5/1985 | Clarke et al. |
| 4,541,831 | A | 9/1985 | Gunther et al. |
| 4,569,780 | A | 2/1986 | Fernholz et al. |
| 4,569,781 | A | 2/1986 | Fernholz et al. |

(Continued)

FOREIGN PATENT DOCUMENTS

| | | |
|---|---|---|
| EP | 0 163 352 | 12/1985 |
| EP | 0 234 082 | 9/1987 |
| EP | 0 266 200 | 5/1988 |
| EP | 0 312 278 | 4/1989 |
| EP | 0 786 515 | 7/1997 |
| GB | 1 553 610 | 10/1979 |
| GB | 2 106 928 | 4/1983 |
| GB | 2 200 365 | 8/1988 |
| GB | 2 245 908 | 1/1992 |
| JP | 63-168500 | 7/1988 |
| WO | WO 93/07245 | 4/1993 |
| WO | WO 94/07980 | 4/1994 |
| WO | WO 95/18212 | 7/1995 |
| WO | WO 96/00274 | 1/1996 |
| WO | WO 96/08553 | 3/1996 |

OTHER PUBLICATIONS

SIIWET® Surfactants, Union Carbide Chemicals and Plastics Company Inc. product brochure, date unknown.

ABIL® B8842, ABIL® B88183, Goldschmidt Chemical Corporation product brochure, date unknown.

Flluorad™ Fluorochemical Surfactants, 3M product brochure, date unknown.

Fluorad™ Flurochemical Surfactant FC–170c, 3M product brochure, date unknown.

*Primary Examiner*—Lorna M. Douyon
(74) *Attorney, Agent, or Firm*—Merchant & Gould P.C.

(57) ABSTRACT

An alkaline detergent composition is provided including a source of alkalinity and an effective soil removing amount of a nonionic surfactant blend. The nonionic surfactant blend includes a monionic surfactant having a hydrophobic and an (EO) group and a nonionic silicone surfactant. The detergent composition provides for the removal of waxy-fatty soil.

26 Claims, 1 Drawing Sheet

U.S. PATENT DOCUMENTS 4,587,029 A 5/1986 Brooks
4,601,844 A 7/1986 Cilley
4,615,819 A 10/1986 Leng et al.
4,624,713 A 11/1986 Morganson et al.
4,654,161 A 3/1987 Kollmeier et al.
4,722,802 A 2/1988 Hutchings et al.
4,725,376 A 2/1988 Copeland
4,753,755 A 6/1988 Gansser
RE32,818 E 1/1989 Fernholz et al.
4,798,724 A 1/1989 Khanns
4,818,421 A 4/1989 Boris et al.
4,820,440 A 4/1989 Hemm et al.
4,820,449 A 4/1989 Menke et al.
4,822,854 A 4/1989 Ciolino
4,846,989 A 7/1989 Killa
4,861,518 A 8/1989 Morganson et al.
4,879,051 A 11/1989 Lo et al.
4,879,063 A 11/1989 Wood-Rethwill et al.
4,919,838 A 4/1990 Tibbetts et al.
4,931,202 A 6/1990 Cotter et al.
4,933,100 A 6/1990 Ramachandran
4,933,102 A 6/1990 Olson
4,960,533 A 10/1990 Wisniewski et al.
4,971,714 A 11/1990 Lokkesmoe et al.
4,978,471 A 12/1990 Starch
5,019,346 A 5/1991 Richter
5,030,376 A 7/1991 Lee et al.
5,061,392 A 10/1991 Bruegge et al.
5,064,554 A 11/1991 Jacobs et al.
5,064,561 A 11/1991 Rouillard
5,066,425 A 11/1991 Ofosu-Asante et al.
5,156,794 A 10/1992 Nakanishi et al.
5,198,198 A 3/1993 Gladfelter et al.
5,234,615 A 8/1993 Gladfelter et al.
5,254,284 A 10/1993 Barone et al.
5,316,688 A * 5/1994 Gladfelter et al. ..... 510/224
5,318,728 A 6/1994 Surutzidis et al.
5,382,377 A 1/1995 Raehse et al.
5,397,506 A 3/1995 Groth et al.
5,407,598 A 4/1995 Olson et al.
5,437,809 A 8/1995 Chaudhuri
5,439,609 A 8/1995 Paszek
5,474,698 A 12/1995 Rolando
5,500,154 A 3/1996 Bacon et al.
5,536,436 A 7/1996 Pramod
5,543,082 A 8/1996 McGee et al.
5,560,748 A 10/1996 Surutzidis et al.
5,589,099 A 12/1996 Baum
5,603,776 A 2/1997 Lentsch et al.
5,880,088 A 3/1999 Lentsch et al.
5,880,089 A 3/1999 Lentsch et al.
6,060,444 A 5/2000 Schulz et al.
6,164,296 A 12/2000 Lentsch et al.
6,489,278 B1 12/2002 Lentsch et al.
6,664,219 B1 12/2003 Lentsch et al.
6,673,765 B1 1/2004 Schulz et al.
6,767,884 B2 7/2004 Lentsch et al.

* cited by examiner

COMBINATION OF A NONIONIC SILICONE SURFACTANT AND A NONIONIC SURFACTANT IN A SOLID BLOCK DETERGENT

This application is a continuation of U.S. application Ser. No. 10/696,317 that was filed with the United States Patent and Trademark Office on Oct. 28, 2003, and that issued as U.S. Pat. No. 6,767,884 on Jul. 27, 2004, which is a continuation of U.S. application Ser. No. 09/715,638 that was filed with the United States Patent and Trademark Office on Nov. 17, 2000, and that issued as U.S. Pat. No. 6,664,219 on Dec. 16, 2003, which is a continuation of U.S. application Ser. No. 09/228,633 that was filed with the United States Patent and Trademark Office on Jan. 11, 1999, and that issued as U.S. Pat. No. 6,164,296 on Dec. 26, 2000, which is a divisional of U.S. application Ser. No. 08/782,336 that was filed with the United States Patent and Trademark Office on Jan. 13, 1997, and that issued as U.S. Pat. No. 6,489,278 on Dec. 3, 2002, which is a continuation-in-part of U.S. application Ser. No. 08/441,252 that was filed with the United States Patent and Trademark Office on May 15, 1995, and which is now abandoned, which is a continuation-in-part application of U.S. application Ser. No. 08/176,541 that was filed with the United States Patent and Trademark Office on Dec. 30, 1993, and which is now abandoned. U.S. application Ser. Nos. 10/696,317; 09/715,638; 09/228,633; 08/782,336; 08/441,252; and 08/176,541 are incorporated herein by reference.

FIELD OF THE INVENTION

The invention relates to a laundry, warewashing, CIP, hard surface, etc. detergent composition that can take the form of a powder, pellet, brick or solid block detergent. Each physical embodiment of the detergent can be packaged in an appropriate packaging system for distribution and sale. Typically, the detergent composition contains a source of alkalinity and an improved surfactant package that substantially improves soil removal and particularly improves soil removal of waxy/fatty soils common-in a number of soil locations.

The invention also relates to an alkaline warewashing detergent composition in the form of a flake, powder, pellet, block, etc., using a blend of surfactants to enhance cleaning properties. More specifically, the invention relates to an alkaline cleaning system that contains a source of alkalinity, a cooperating blend of surfactants and other cleaning materials that can substantially increase the cleaning capacity, relating to specific fatty or waxy soils. The detergent can also contain a variety of other chemical agents including water softening agents, sanitizers, sequestrants, anti-redeposition agents, defoaming agents, etc. useful in detergent compositions useful in many applications.

BACKGROUND OF THE INVENTION

Detergent compositions comprising a source of alkalinity, a surfactant or surfactant package combined with other general washing chemicals have been known for many years. Such materials have been used in laundry products, warewashing compositions, CIP cleaners, hard surface cleaners etc. Virtually any cleaner containing a source of alkalinity that is designed or formulated for dilution into an aqueous based composition can be used within this broad general concept. The powder dishwasher detergents are disclosed in, for example, in Dos et al., U.S. Pat. No. 3,956,199, Dos et al., U.S. Pat. No. 3,963,635. Further, Macmullen et al., U.S. Pat. No. 3,032,578 teach alkaline dishwashing detergents containing a chlorine source, an organic phosphonate, a surfactant composition and a water treating agent. Similarly, Almsted et al., U.S. Pat. No. 3,351,557, Davis et al, U.S. Pat. No. 3,341,459, Zimmerman et al., U.S. Pat. Nos. 3,202,714 and 3,281,368 teach built liquid laundry detergent comprising a source of alkalinity and nonionic surfactant materials.

Powdered general purpose, warewashing and laundry detergents have been used for many years. The manufacture and use of solid block cleaning compositions were pioneered in technology disclosed in Fernholz et al., U.S. Reissue Pat. Nos. 32,763 and 32,818 and in Heile et al., U.S. Pat. Nos. 4,595,520 and 4,680,134. Gansser, U.S. Pat. No. 4,753,441, presents a solid detergent technology in a cast solid form using a nitrilotriacetate sequestrant. The solid block detergents move quickly replaced a large proportion of conventional powder and liquid forms of warewashing detergents and other products in commercial, institutional and industrial laundry, warewashing etc. washing and cleaning markets for safety convenience and other reasons. The development of these solid block cleaning compositions revolutionized the manner in which many cleaning and sanitizing compositions including warewashing detergent compositions are manufactured and used in commercial, institutional and industrial cleaning locations. Solid block compositions offer certain advantages over conventional liquids, powders, granules, pastes, pellets and other forms of detergents. Such advantages include safety, improved economy, improved handling, etc.

In the manufacture of powdered detergents, powdered ingredients are typically dry blended or agglomerated in known manufacturing facilities to produce a physically and segregation stable powder composition that can be packaged, distributed and sold without substantial changes in product uniformity. Liquid materials are commonly blended in aqueous or nonaqueous solvent materials, diluted with a proportion of water to produce an aqueous based liquid concentrate which is then packaged, distributed and sold. Solid block detergent compositions are commonly manufactured and formed into a solid often using a hardening mechanism.

In the manufacture of solid detergents, various hardening mechanisms have been used in the manufacture of cleaning and sanitizing compositions for the manufacture of the solid block. Active ingredients have been combined with a hardening agent under conditions that convert the hardening agent from a liquid to a solid rendering the solid material into a mechanically stable block format. One type of such hardening systems is a molten process disclosed in the Fernholz patents. In the Fernholz patents, a sodium hydroxide hydrate, having a melting point of about 55°–60° C., acts as a hardening agent. In the manufacturing process, a molten sodium hydroxide hydrate liquid melt is formed into which is introduced solid particulate materials. A suspension or solution of the solid particulate materials in the molten caustic is formed and is introduced into plastic bottles called capsules, also called container shaped molds for solidification. The material cools, solidifies and is ready for use. The suspended or solubilized materials are evenly dispersed throughout the solid and are dispensed with the caustic cleaner.

Similarly, in Heile et al., an anhydrous carbonate or an anhydrous sulfate salt is hydrated in the process forming a hydrate, having a melting point about 55° C., that comprises proportions of monohydrate, heptahydrate and decahydrate solid. The carbonate hydrate is used similarly to the caustic hydrate of Fernholz et al to make a solid block multicomponent detergent. Other examples of such molten processes include Morganson, U.S. Pat. No. 4,861,518 which discloses a solid cleaning concentrate formed by heating an ionic and nonionic surfactant system with the hardening agent such as polyethylene glycol, at temperatures that range greater than about 38° C. to form a melt. Such a melt is combined with other ingredients to form a homogeneous dispersion which is then poured into a mold to harden. Morganson et al, U.S. Pat. No. 5,080,819 teaches a highly alkaline cast solid composition adapted for use at low temperature warewashing temperatures using effective cleaning amounts of a nonionic surfactant to enhance soil removal. Gladfelter, U.S. Pat. No. 5,316,688 teaches a solid block alkaline detergent composition wrapped in a water soluble or water dispersible film packaging.

Solid pelletized materials are shown in Gladfelter, U.S. Pat. Nos. 5,078,301, 5,198,198 and 5,234,615 and in Gansser U.S. Pat. Nos. 4,823,441 and 4,931,202. Such pelletized materials are typically made by extruding a molten liquid or by compressing a powder into a tablet or pellet. Extruded nonmolten alkaline detergent materials are disclosed in Gladfelter et al., U.S. Pat. No. 5,316,688.

These powdered, pellet, liquid and solid block detergent compositions have acceptable cleaning properties for most commercial purposes. Materials introduced into customer based testing or sold in the market place have achieved commercially acceptable and uniformly passing cleaning results. However, we have found, under certain conditions of fabric, ware, substrate, water hardness, machine type, soil type and load, etc., some stains have resisted removal during the cleaning process. We have found a number of waxy-fatty soils that appear to harden on the surface of ware and resist even highly alkaline cleaning detergents under certain conditions. Such soils are common in the cleaning environment and are typically hydrophobic materials that can form thin films on the surface of a variety of items. We have found that lipsticks soils can act as a soil model for this broad hydrophobic waxy-fatty soil genus. Lipsticks typically contain a large proportion of lipid, fatty and wax-like materials in a relatively complex mixture including waxy compositions, fatty materials, inorganic components, pigments, etc. The wax-like materials typically include waxes such as candelilla wax, paraffin wax, carnuba wax, etc. Fatty ingredients typically include lanolin derivatives, isopropyl isostearate, octyl hydroxy stearate, castor oil, cetyl alcohol, cetyl lactate, and other materials. Such lipid materials are typically difficult to remove under the best of circumstances. More importantly, we believe the castor oil component of lipstick formulations are unsaturated materials that can act like drying oils and can oxidatively crosslink in thin films to form crosslinked or pseudocrosslinked soil layers that are highly resistant to detergents. The formation of lipstick soils and other similar thin film, fatty or waxy, soils resistant to removal has been a stubborn soil requiring attention for many years. Under certain circumstances such waxy-fatty soils can remain on glassware, cups, flatware, dishware, etc.

A substantial need exists to improve the cleaning properties of solid block detergent materials and particularly as it relates to hydrophobic (fatty, crosslinked fatty or waxy) soils for which lipstick stains are a good model.

A number of avenues can and have been explored in such an improvement attempt. Examples of research areas can include experimentation in the effects of water temperature, sequestrants that reduce water hardness, the effect of various alkaline sources, the effects of sequestrant types and blends, solvents effects and surfactant choice. The surfactants that can be used in the cast solid materials are vast. There are large numbers of anionic, nonionic, cationic, amphoteric or zwitterionic, etc. surfactants that can be used singly or in combinations of similar or diverse types. Even after substantial experimentation, waxy-fatty soils continue to pose a serious problem.

BRIEF DESCRIPTION OF THE INVENTION

The invention relates to a detergent composition having a blend of surfactants that substantially enhance cleaning properties of a detergent composition for removal of stubborn hydrophobic soils including waxy-fatty soils for which lipstick stains are a good soil model. The detergent compositions of the invention can be formulated in a variety of product formats including liquid, powder, pellet, solid block, agglomerate powder etc. The detergent composition comprises a source of alkalinity with a first nonionic surfactant and a second nonionic substituted silicone surfactant. The combination of a first nonionic surfactant and a second nonionic silicone surfactant, produces surprisingly effective removal of hydrophobic waxy-fatty soil from the surface of ware. The second nonionic silicone surfactant and the nonionic surfactant cooperate to reduce surface tension to a surprising degree. The surface tension reduction appears to be roughly related to soil removal. The combination of surfactants also appears to affect the interface between the soil and the ceramic or siliceous surface of glassware or tableware.

For the purpose of this patent application, the term "nonionic surfactant" typically indicates a surfactant having a hydrophobic group and at least one hydrophilic group comprising a $(EO)_x$ group wherein x is a number that can range from about 1 to about 100. The combination of a generic hydrophobic group and such a hydrophilic group provides substantial surfactancy to such a composition. The nonionic silicone surfactant is typically a surfactant having a hydrophobic silicone (polydimethyl siloxane) group with at least one pendent hydrophilic group or groups that can comprise $(EO)_x$ wherein x is a number of about 1 to about 100 in a surfactant molecule. The first nonionic surfactant can comprise any nonionic surfactant such as a silicone free nonionic surfactant or a nonionic silicone surfactant, however, the second nonionic substituted silicone surfactant cannot comprise a nonionic free of a hydrophobic silicone group.

DETAILED DESCRIPTION OF THE PREFERRED EMBODIMENTS

Figure 1:
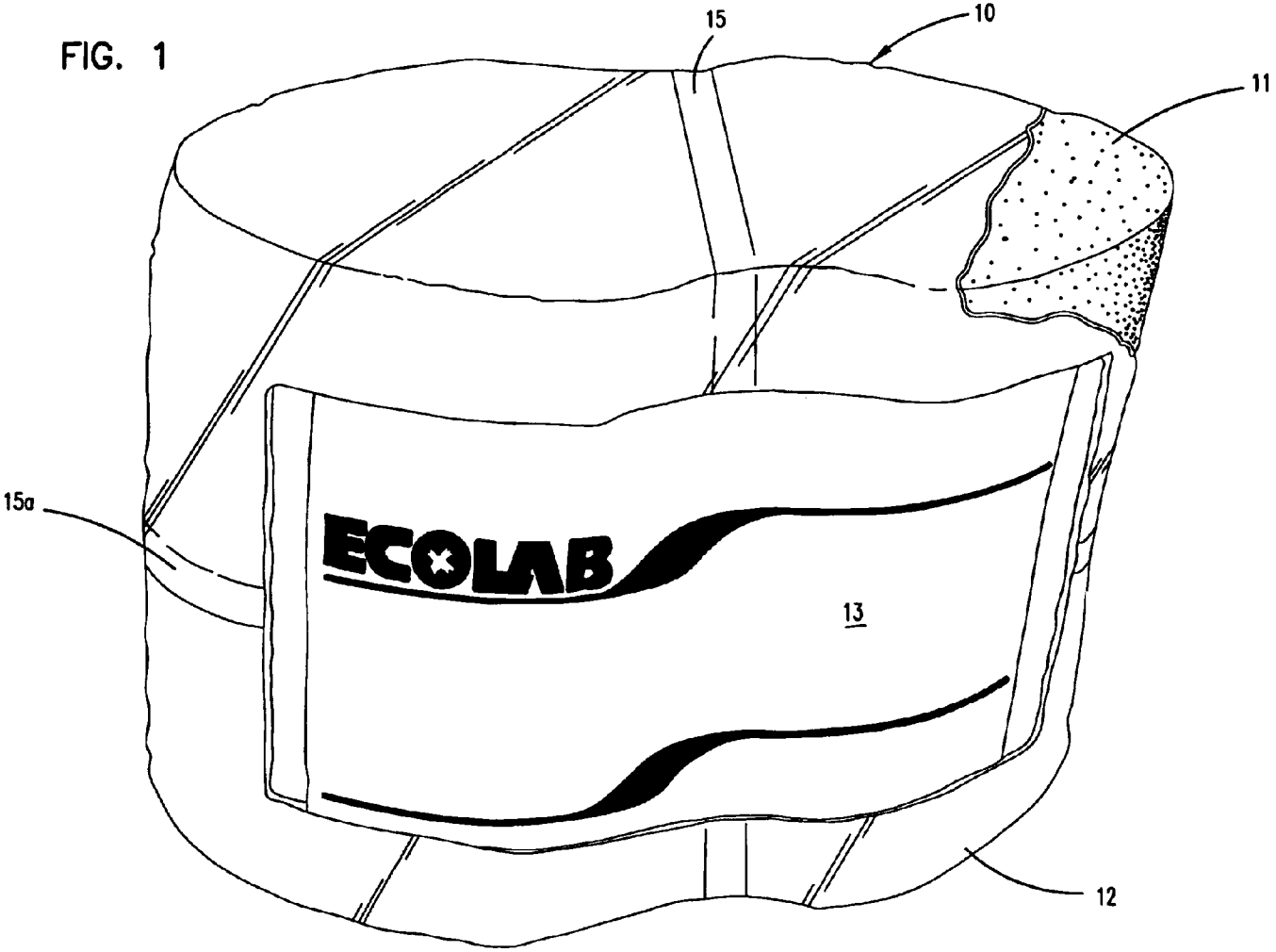
FIG. 1 is a drawing of a current embodiment of the solid block detergent of the invention. The solid block having a mass of about 3.0 kilograms is made in an extrusion process in which individual or selected mixed components are introduced serially through material introduction ports into an extruder, the extruded block is formed with a useful profile at the extruder exit die and is divided into useful 3.0 kg blocks after extrusion. Once hardened, the material can be packaged (e.g.) in a shrink wrap that can be removed before use or dissolved during use.

The detergent composition of the invention combines a source of alkalinity, a first nonionic surfactant and a second nonionic silicone surfactant in an alkaline detergent composition. Optionally, the compositions of the invention can also include a solidifying agent, sequestrants, sanitizing and disinfectant agents, additional surfactants and any variety of other formulatory and application adjuvants. The term detergent composition should be interpreted broadly to include any cleaning, soil conditioning, antimicrobial, soil preparatory, etc. chemical or other liquid, powder, solid, etc. composition which has an alkaline pH and the surfactant blend of the invention in the different physical formats discussed above.

The first nonionic surfactants useful in the present invention may be solid or liquid. The nonionic surfactant is used in the compositions of the present invention in an amount from about 0.5% to about 50% by weight, preferably from about 1.0% to about 40% by weight, and most preferably from about 2.0% to about 30% by weight.

Most commonly, nonionic surfactants are compounds produced by the condensation of an ethylene oxide (forming groups that are hydrophilic in nature) with an organic hydrophobic compound which can be aliphatic, alkyl or alkyl aromatic (hydrophobic) in nature. The length of the hydrophilic polyoxyethylene moiety which can be condensed with another particular hydrophobic compound can be readily adjusted, in size or combined with (PO) propylene oxide, other alkylene oxides or other substituents such as benzyl caps to yield a water-soluble compound having the desired degree of balance between hydrophilic and hydrophobic elements.

Examples of suitable types of nonionic surfactant include the polyethylene oxide condensates of alkyl phenols. These compounds include the condensation products of alkyl phenols having an alkyl group containing from about 6 to 12 carbon atoms in either a straight chain or branched chain configuration, with ethylene oxide. Ethylene oxide being present in amounts equal to 5 to 20 moles of ethylene oxide per mole of alkyl phenol. Examples of compounds of this type include nonyl phenol condensed with an average of about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, diisoctylphenol condensed with about 15 moles of ethylene oxide per mole of phenol. Commercially available nonionic surfactants of this type include Igepal CO-610 marketed by the GAF Corporation; and Triton CF-12, X-45, X-114, X-100 and X-102, all marketed by the Rohm and Haas Company.

The condensation products of aliphatic alcohols with ethylene oxide can also exhibit useful surfactant properties. The alkyl chain of the aliphatic alcohol may either be straight or branched and generally contains from about 3 to about 22 carbon atoms. Preferably, there are from about 3 to about 18 moles of ethylene oxide per mole of alcohol. The polyether can be conventionally end capped with acyl groups including methyl, benzyl, etc. groups. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. Examples of commercially available nonionic surfactants of this type include Tergitol 15-S-9 marketed by the Union Carbide Corporation. PLURAFAC® RA-40 marketed by BASF Corp. Neodol 23-6.5 marketed by the Shell Chemical Company and Kyro EOB marketed by the Procter & Gamble Company.

The condensation products of ethylene oxide with a hydrophobic base formed by the condensation of propylene oxide with propylene glycol can be used. The hydrophobic portion of these compounds has a molecular weight of from about 1,500 to 1,800 and of course exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product. Examples of compounds of this type include certain of the commercially available Pluronic surfactants marketed by the Wyandotte Chemicals Corporation.

The condensation products of ethylene oxide with the product resulting from the reaction of propylene oxide and ethylene diamine can be used. The hydrophobic base of these products consists of the reaction product of ethylene diamine and excess propylene oxide, said base having a molecular weight of from about 2,500 to about 3,000. This base is condensed with ethylene oxide to the extent that the condensation product contains from about 40 to about 80 percent by weight of polyoxyethylene and has a molecular weight of from about 5,000 to about 11,000. Examples of this type of nonionic surfactant include certain of the commercially available Tetronic compounds marketed by the Wyandotte Chemical Corporation. Mixtures of the above surfactants are also useful in the present invention.

Preferred nonionic surfactant used herein are the ethoxylated nonionics, both from the standpoint of availability and cleaning performance. Specific examples of alkoxylated nonionic surfactants include, but are not limited to a benzyl ether of a $C_{6-24}$ linear alcohol 5–15 mole ethoxylate, PLURAFAC® RA-40, a straight chain alcohol ethoxylate, Triton CF-21 an alkyl aryl polyether, Triton CF-54, a modified polyethoxy adduct, and others. Another example of an alkoxylated nonionic surfactant includes a benzyl capped $C_{8-12}$ linear alcohol 6 to 16 mole ethoxylate.

The second nonionic can comprise a silicon surfactant of the invention that comprises a modified dialkyl, preferably a dimethyl polysiloxane. The polysiloxane hydrophobic group is modified with one or more pendent hydrophilic polyalkylene oxide group or groups. Such surfactants provide low surface tension, high wetting, antifoaming and excellent stain removal. We have found that the silicone nonionic surfactants of the invention, in a detergent composition with another nonionic surfactant can reduce the surface tension of the aqueous solutions, made by dispensing the detergent with an aqueous spray, to between about 35 and 15 dynes/centimeter, preferably between 30 and 15 dynes/centimeter. The silicone surfactants of the invention comprise a polydialkyl siloxane, preferably a polydimethyl siloxane to which polyether, typically polyethylene oxide, groups have been grafted through a hydrosilation reaction. The process results in an alkyl pendent (AP type) copolymer, in which the polyalkylene oxide groups are attached along the siloxane backbone through a series of hydrolytically stable Si—C bond.

These nonionic substituted poly dialkyl siloxane products have the following generic formula:

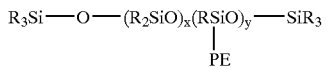

wherein PE represents a nonionic group, preferably $—CH_2—(CH_2)_p—O-(EO)_m(PO)_n-Z$, EO representing ethylene oxide, PO representing propylene oxide, x is a number that ranges from about 0 to about 100, y is a number that ranges from about 1 to about 100, m, n and p are numbers that range from about 0 to about 50, m+n≧1 and z represents hydrogen or R wherein each R independently represents a lower ($C_{1-6}$) straight or branched alkyl.

Preferred silicone nonionic surfactants have the formula:

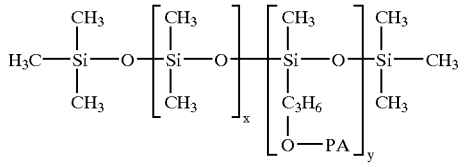

PA = —$(C_4H_4O)_a(C_3H_6O)_bR$ or

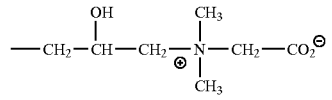

wherein x represent a number that ranges from about 0 to about 100, y represent a number that ranges from about 1 to about 100, a and b represent numbers that independently range from about 0 to about 60, a+b≧1, and each R is independently H or a lower straight or branched ($C_{1-6}$) alkyl.

A second class of nonionic silicone surfactants is an alkoxy-end-blocked (AEB type) that are less preferred because the Si—O— bond offers limited resistance to hydrolysis under neutral or slightly alkaline conditions, but breaks down quickly in acidic environments.

Preferred surfactants are sold under the SILWET® trademark or under the ABIL® B trademark. One preferred surfactant, SILWET® L77, has the formula:

$$(CH_3)_3Si—O(CH_3)Si(R^1)O—Si(CH_3)_3$$

wherein $R^1$=—$CH_2CH_2CH_2$—O—$[CH_2CH_2O]_zCH_3$; wherein z is 4 to 16 preferably 4 to 12, most preferably 7–9.

To provide an alkaline pH, the composition comprises an alkalinity source. Generally, the alkalinity source raises the pH of the composition to at least 10.0 in a 1 wt-% aqueous solutions and preferably to a range of from about 10.5 to 14. Such pH is sufficient for soil removal and sediment breakdown when the chemical is placed in use and further facilitates the rapid dispersion of soils. The general character of the alkalinity source is limited only to those chemical compositions which have a substantial aqueous solubility. Exemplary alkalinity sources include an alkali metal silicate, hydroxide, phosphate, or carbonate.

The alkalinity source can include an alkali metal hydroxide including sodium hydroxide, potassium hydroxide, lithium hydroxide, etc. Mixtures of these hydroxide species can also be used. Alkaline metal silicates can also act as a source of alkalinity for the detergents of the invention. Useful alkaline metal silicates correspond with the general formula ($M_2O$:$SiO_2$) wherein for each mole of $M_2O$ there is less than one mole of $SiO_2$. Preferably for each mole of $SiO_2$ there is from about 1 to about 100 moles of $M_2O$ wherein M comprises sodium or potassium. Preferred sources of alkalinity are alkaline metal orthosilicate, alkaline metal metasilicate, and other well known detergent silicate materials.

The alkalinity source can include an alkali metal carbonate. Alkali metal carbonates which may be used in the invention include sodium carbonate, potassium carbonate, sodium or potassium bicarbonate or sesquicarbonate, among others. Preferred carbonates include sodium and potassium carbonates. These sources of alkalinity can be used the detergents of the invention at concentrations about 5 wt-% to 70 wt-%, preferably from about 15 wt-% to 65 wt-%, and most preferably from about 30 wt-% to 55 wt-%.

In order to soften or treat water, prevent the formation of precipitates or other salts, the composition of the present invention generally comprises components known as chelating agents, builders or sequestrants. Generally, sequestrants are those molecules capable of complexing or coordinating the metal ions commonly found in service water and thereby preventing the metal ions from interfering with the functioning of detersive components within the composition. The number of covalent bonds capable of being formed by a sequestrant upon a single hardness ion is reflected by labeling the sequestrant as bidentate (2), tridentate (3), tetradendate (4), etc. Any number of sequestrants may be used in accordance with the invention. Representative sequestrants include salts of amino carboxylic acids, phosphonic acid salts, water soluble acrylic polymers, among others.

Suitable amino carboxylic acid chelating agents include N-hydroxyethyliminodiacetic acid, nitrilotriacetic acid (NTA), ethylenediaminetetraacetic acid (EDTA), N-hydroxyethyl-ethylenediaminetriacetic acid (HEDTA), and diethylenetriaminepentaacetic acid (DTPA). When used, these amino carboxylic acids are generally present in concentrations ranging from about 1 wt-% to 50 wt-%, preferably from about 2 wt-% to 45 wt-%, and most preferably from about 3 wt-% to 40 wt-%.

Other suitable sequestrants include water soluble acrylic polymers used to condition the wash solutions under end use conditions. Such polymers include polyacrylic acid, polymethacrylic acid, acrylic acid-methacrylic acid copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, or mixtures thereof. Water soluble salts or partial salts of these polymers such as their respective alkali metal (for example, sodium or potassium) or ammonium salts can also be used. The weight average molecular weight of the polymers is from about 4000 to about 12,000. Preferred polymers include polyacrylic acid, the partial sodium salts of polyacrylic acid or sodium polyacrylate having an average molecular weight within the range of 4000 to 8000. These acrylic polymers are generally useful in concentrations ranging from about 0.5 wt-% to 20 wt-%, preferably from about 1 to 10, and most preferably from about 1 to 5.

Also useful as sequestrants are alkali metal phosphates, condensed and cyclic phosphates, phosphonic acids and phosphonic acid salts. Useful phosphates include alkali metal pyrophosphate, an alkali metal polyphosphate such a sodium tripolyphosphate (STPP) available in a variety of particle sizes. Such useful phosphonic acids include, mono, di, tri and tetra-phosphonic acids which can also contain groups capable of forming anions under alkaline conditions such as carboxy, hydroxy, thio and the like. Among these are phosphonic acids having the generic formula motif $R_1N[CH_2PO_3H_2]_2$ or $R_2C(PO_3H_2)_2OH$, wherein $R_1$ may be -[(lower $C_{1-6}$)alkylene]-N—$[CH_2PO_3H_2]_2$ or a third —$(CH_2PO_3H_2)$ moiety; and wherein $R_2$ is selected from the group consisting of a lower ($C_1$–$C_6$) alkyl. The phosphonic acid may also comprise a low molecular weight phosphonopolycarboxylic acid such as one having about 2–4 carboxylic acid moieties and about 1–3 phosphonic acid groups. Such acids include 1-hydroxyethane-1,1-diphosphonic acid $CH_3C(OH)[PO(OH)_2]_2$; aminotri (methylenephosphonic acid) $N[CH_2PO(OH)_2]_3$; aminotri (methylenephosphonate), sodium salt

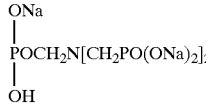

2-hydroxyethyliminobis(methylenephosphonic acid) $HOCH_2CH_2N[CH_2PO(OH)_2]_2$;

diethylenetriaminepenta(methylenephosphonic acid) $(HO)_2POCH_2N[CH_2CH_2N[CH_2PO(OH)_2]_2]_2$;

diethylenetriaminepenta(methylenephosphonate), sodium salt $C_9H_{(28-x)}N_3Na_xO_{15}P_5$ (x=7);

hexamethylenediamine(tetramethylenephosphonate), potassium salt $C_{10}H_{(28-x)}N_2K_xO_{12}P_4$ (x=6);

bis(hexamethylene)triamine(pentamethylenephosphonic acid) $(HO_2)POCH_2N[(CH_2)_6N[CH_2PO(OH)_2]_2]_2$; and phosphorus acid $H_3PO_3$.

The preferred phosphonate is aminotrimethylenephosphonic acid or salts thereof combined optionally with diethylenetriaminepenta(methylenephosphonic acid).

When used as a sequestrant in the invention, phosphonic acids or salts are present in a concentration ranging from about 0.25 to 25 wt %, preferably from about 1 to 20 wt %, and most preferably from about 1 to 18 wt % based on the solid detergent.

The invention may also comprise a solidifying agent to create a solid detergent mass from a blend of chemical components. Generally, any agent or combination of agents which provides a requisite degree-of solidification and aqueous solubility may be used with the invention. A solidification agent may be selected from any organic or inorganic compound which imparts a solid character and/or controls the soluble character of the present composition when placed in an aqueous environment. The solidifying agent may provide for controlled dispensing by using solidification agents which have a relative increase in aqueous solubility. For systems which require less aqueous solubility or a slower rate of dissolution an organic nonionic or amide hardening agent may be appropriate. For a higher degree of aqueous solubility, an inorganic solidification agent or a more soluble organic agent such as urea. Compositions which may be used with the present invention to vary hardness and solubility include amides such as stearic monoethanolamide, lauric diethanolamide, and stearic diethanolamide. Nonionic surfactants have also been found to impart varying degrees of hardness and solubility when combined with a coupler such as propylene glycol or polyethylene glycol. Nonionics useful in this invention include nonylphenol ethoxylates, linear alkyl alcohol ethoxylates, ethylene oxide/propylene oxide block copolymers such as the Pluronic™ surfactants commercially available from BASF Wyandotte.

Nonionic surfactants particularly desirable as hardeners are those which are solid at room temperature and have an inherently reduced aqueous solubility as a result of the combination with the coupling agent.

Other surfactants which may be used as solidifying agents include anionic surfactants which have high melting points to provide a solid at the temperature of application. Anionic surfactants which have been found most useful include linear alkyl benzene sulfonate surfactants, alcohol sulfates, alcohol ether sulfates, and alpha olefin sulfonates. Generally, linear alkyl benzene sulfonates are preferred for reasons of cost and efficiency.

Amphoteric or zwitterionic surfactants are also useful in providing detergency, emulsification, wetting and conditioning properties. Representative amphoteric surfactants include N-coco-3-aminopropionic acid and acid salts, N-tallow-3-iminodiproprionate salts. As well as N-lauryl-3-iminodiproprionate disodium salt, N-carboxymethyl-N-cocoalkyl-N-dimethylammonium hydroxide, N-carboxymethyl-N-dimethyl-N-(9-octadecenyl) ammonium hydroxide, (1-carboxyheptadecyl) trimethylammonium hydroxide, (1-carboxyundecyl) trimethylammonium hydroxide, N-cocoamidoethyl-N-hydroxyethylglycine sodium salt, N-hydroxyethyl-N-stearamidoglycine sodium salt, N-hydroxyethyl-N-lauramido-β-alanine sodium salt, N-cocoamido-N-hydroxyethyl-β-alanine sodium salt, as well as mixed alicyclic amines, and their ethoxylated and sulfated sodium salts, 2-alkyl-1-carboxymethyl-1-hydroxyethyl-2-imidazolinium hydroxide sodium salt or free acid wherein the alkyl group may be nonyl, undecyl, or heptadecyl. Also useful are 1,1-bis(carboxymethyl)-2-undecyl-2-imidazolinium hydroxide disodium salt and oleic acid-ethylenediamine condensate, propoxylated and sulfated sodium salt. Amine oxide amphoteric surfactants are also useful. This list is by no means exclusive or limiting.

Other compositions which may be used as hardening agents with the composition of the invention include urea, also known as carbamide, and starches which have been made water soluble through an acid or alkaline treatment. Also useful are various inorganics which either impart solidifying properties to the present composition and can be processed into pressed tablets for carrying the alkaline agent. Such inorganic agents include calcium carbonate, sodium sulfate, sodium bisulfate, alkali metal phosphates, anhydrous sodium acetate and other known hydratable compounds. We have also found a novel hardening or binding agent for alkaline metal carbonate detergent compositions. We believe the binding agent comprises an amorphous complex of an organic phosphonate compound, sodium carbonate, and water. The proportions of this binding hardening agent is disclosed in copending U.S. Ser. No. 08/781,493 which issued as U.S. Pat. No. 6,177,392 on Jan. 23, 2001 which is expressly incorporated by reference herein. This carbonate phosphate water binding agent can be used in conjunction with other hardening agents such as a nonionic, etc.

The solidifying agents can be used in concentrations which promote solubility and the requisite structural integrity for the given application. Generally, the concentration of solidifying agent ranges from about 5 wt-% to 35 wt, preferably from about 10 wt-% to 25 wt-%, and most preferably from about 15 wt-% to 20 wt-%.

The detergent composition of the invention may also comprise a bleaching source. Bleaches suitable for use in the detergent composition include any of the well known bleaching agents capable of removing stains from such substrates as dishes, flatware, pots and pans, textiles, countertops, appliances, flooring, etc. without significantly damaging the substrate. These compounds are also capable of providing disinfecting and sanitizing antimicrobial efficacy in certain applications. A nonlimiting list of bleaches include hypochlorites, chlorites, chlorinated phosphates, chloroisocyanates, chloroamines, etc.; and peroxide compounds such as hydrogen peroxide, perborates, percarbonates, etc.

Preferred bleaches include those bleaches which liberate an active halogen species such as $Cl_2$, $Br_2$, $OCl^-$, or $OBr^-$ under conditions normally encountered in typical cleaning processes. Most preferably, the bleaching agent releases $Cl_2$ or $OCl^-$. A nonlimiting list of useful chlorine releasing bleaches includes calcium hypochloride, lithium hypochloride, chlorinated trisodium phosphate, sodium dichloroisocyanaurate, chlorinated trisodium phosphate, sodium dichloroisocyanurate, potassium dichloroisocyanurate, pentaisocyanurate, trichloromelamine, sulfondichloro-amide, 1,3-dichloro 5,5-dimethyl hydantoin, N-chlorosuccinimide, N,N'-dichloroazodicarbonimide, N,N'-chloroacetylurea,N,N'-dichlorobiuret, trichlorocyanuric acid and hydrates thereof. Because of their higher activity and higher bleaching efficacies the most preferred bleaching agents are the alkaline metal salts of dichloroisocyanurates and the hydrates thereof. Generally, when present, the actual concentration of bleach source or agent (in wt-% active) may comprise about 0.5 to 20 wt-%, preferably about 1 to 10 wt-%, and most preferably from about 2 to 8 wt-% of the solid detergent composition.

The composition of the invention may also comprise a defoaming surfactant useful in warewashing compositions. A defoamer is a chemical compound with a hydrophobe-hydrophile balance suitable for reducing the stability of protein foam. The hydrophobicity can be provided by an oleophilic portion of the molecule. For example, an aromatic alkyl or alkyl group, an oxypropylene unit or oxypropylene chain, or other oxyalkylene functional groups other than oxyethylene provide this hydrophobic character. The hydrophilicity can be provided by oxyethylene units, chains, blocks and/or ester groups. For example, organophosphate esters, salt type groups or salt forming groups all provide hydrophilicity within a defoaming agent. Typically, defoamers are nonionic organic surface active polymers having hydrophobic groups, blocks or chains and hydrophilic ester groups, blocks, units or chains. However, anionic, cationic and amphoteric defoamers are also known. Phosphate esters are also suitable for use as defoaming agents. For example, esters of the formula RO—$(PO_3M)_n$-R wherein n is a number ranging from 1 to about 60, typically less than 10 for cyclic phosphates, M is an alkali metal and R is an organic group or M, with at least one R being an organic group such as an oxyalkylene chain. Suitable defoaming surfactants include ethylene oxide/propylene oxide blocked nonionic surfactants, fluorocarbons and alkylated phosphate esters. When present defoaming agents may be present in a concentration ranging from about 0.1 wt-% to 10 wt-%, preferably from about 0.5 wt-% to 6 wt-% and most preferably from about 1 wt-% to 4 wt-% of the composition.

DETAILED DESCRIPTION OF THE DRAWINGS

FIG. 1 is a drawing of a preferred embodiment of the packaged solid block detergent 10 of the invention. The detergent has a unique elliptical profile with a pinched waist. This profile ensures that this block with its particular profile can fit only spray on dispensers that have a correspondingly shaped pinch waisted elliptical profile location for the solid block detergent. We are unaware of any solid block detergent having this shape in the market place. The shape of the solid block ensures that no unsuitable substitute for this material can easily be placed into the dispenser for use in a warewashing machine. In FIG. 1 the overall solid block product 10 is shown having a cast solid block 11 (revealed by the removal of packaging 12). The packaging includes a label 13 adhered to the packaging 12. The film wrapping can easily be removed using a weakened tear line 15 or fracture line or 15*a* incorporated in the wrapping.

The foregoing description of the invention provides an understanding of the individual components that can be used in formulating the solid block detergents of the invention. The following examples illustrate the preferred embodiments of the invention, the aqueous surface tension and waxy soil cleaning properties of the invention and contain a best mode.

In the manufacture of the detergent, a dry bend powder can be made by blending powdered components into a complete formulation. Liquid ingredients can be pre-adsorbed onto dry components or encapsulated prior to mixing. Agglomerated materials can be made using known techniques and equipment. In manufacture of the solid detergent of the invention, the ingredients are mixed together at high shear to form a substantially homogenous consistency wherein the ingredients are distributed substantially evenly throughout the mass. The mixture is then discharged from the mixing system by casting into a mold or other container, by extruding the mixture, and the like. Preferably, the mixture is cast or extruded into a mold or other packaging system, that can optionally, but preferably, be used as a dispenser for the composition. The temperature of the mixture when discharged from the mixing system is maintained sufficiently low to enable the mixture to be cast or extruded directly into a packaging system without first cooling the mixture. Preferably, the mixture at the point of discharge is at about ambient temperature, about 30–50° C., preferably about 35–45° C. The composition is then allowed to harden to a solid form that may range from a low density, sponge-like, malleable, caulky consistency to a high density, fused solid, concrete-like block.

In a preferred method according to the invention, the mixing system is a twin-screw extruder which houses two adjacent parallel or counter rotating screws designed to co-rotate and intermesh, the extruder having multiple ingredient inlets, barrel sections and a discharge port through which the mixture is extruded. The extruder may include, for example, one or more feed or conveying sections for receiving and moving the ingredients, a compression section, mixing sections with varying temperature, pressure and shear, a die section to shape the detergent solid, and the like. Suitable twin-screw extruders can be obtained commercially and include for example, Buhler Miag Model No. 62 mm, Buhler Miag, Plymouth, Minn. USA.

Extrusion conditions such as screw configuration, screw pitch, screw speed, temperature and pressure of the barrel sections, shear, throughput rate of the mixture, water content, die hole diameter, ingredient feed rate, and the like, may be varied as desired in a barrel section to achieve effective processing of ingredients to form a substantially homogeneous liquid or semi-solid mixture in which the ingredients are distributed evenly throughout. To facilitate processing of the mixture within the extruder, it is preferred that the viscosity of the mixture is maintained at about 1,000–1,000,000 cP, more preferably about 5,000–200,000 cP.

The extruder comprises a high shear screw configuration and screw conditions such as pitch, flight (forward or reverse) and speed effective to achieve high shear processing of the ingredients to a homogenous mixture. Preferably, the screw comprises a series of elements for conveying, mixing, kneading, compressing, discharging, and the like, arranged to mix the ingredients at high shear and convey the mixture through the extruder by the action of the screw within the barrel section. The screw element may be a conveyor-type screw, a paddle design, a metering screw, and the like. A preferred screw speed is about 20–250 rpm, preferably about 40–150 rpm.

Optionally, heating and cooling devices may be mounted adjacent the extruder to apply or remove heat in order to obtain a desired temperature profile in the extruder. For example, an external source of heat may be applied to one or more barrel sections of the extruder, such as the ingredient inlet section, the final outlet section, and the like, to increase fluidity of the mixture during processing through a section or from one section to another, or at the final barrel section through the discharge port. Preferably, the temperature of the mixture during processing including at the discharge port, is maintained at or below the melting temperature of the ingredients, preferably at about 50–200° C.

In the extruder, the action of the rotating screw or screws will mix the ingredients and force the mixture through the sections of the extruder with considerable pressure. Pressure may be increased up to about 6,000 psig, preferably between about 5–150 psig, in one or more barrel sections to maintain the mixture at a desired viscosity level or at the die to facilitate discharge of the mixture from the extruder.

The flow rate of the mixture through the extruder will vary according to the type of machine used. In general, a flow rate is maintained to achieve a residence time of the mixture within the extruder effective to provide substantially complete mixing of the ingredients to a homogenous mixture, and to maintain the mixture at a fluid consistency effective for continuous mixing and eventual extrusion from the mixture without premature hardening.

When processing of the ingredients is complete, the mixture may be discharged from the extruder through the discharge port, preferably a shaping die for the product outside profile. The pressure may also be increased at the discharge port to facilitate extrusion of the mixture, to alter the appearance of the extrudate, for example, to alter the appearance of the extrudate, for example, to expand it, to make it smoother or grainier in texture as desired, and the like.

The cast or extruded composition eventually hardens due, at least in part, to cooling and/or the chemical reaction of the ingredients. The solidification process may last from one minute to about 2–3 hours, depending, for example, on the size of the cast or extruded composition, the ingredients of the composition, the temperature of the composition, and other like factors. Preferably, the cast or extruded composition "sets up" or begins to harden to a solid form within about 1 minute to about 2 hours, preferably about 5 minutes to about 1 hour, preferably about 1 minute to about 20 minutes.

The above specification provides a basis for understanding the broad meets and bounds of the invention.

The following examples and test data provide an understanding of the specific embodiments of the invention and contain a best mode. These examples are not meant to limit the scope of the invention that has been set forth in the foregoing description. Variation within the concepts of the invention are apparent to those skilled in the art.

EXAMPLE I

| PROTOTYPE FOR TABLE 1 | |
|---|---|
| The following formula: | |
| 12.40% | Water |
| 2.5% | A nonionic comprising a Benzyl capped, linear $C_{10-14}$ alcohol 12.4 mole ethoxylate |

-continued

| PROTOTYPE FOR TABLE 1 | |
|---|---|
| 0.5% | ABIL ® B 8852 |
| 1.572% | Defoamer |
| 4.5% | Spray-dried aminotrimethylene phosphonic acid, pentasodium salt |
| 48.528% | Dense Ash (anhydrous $Na_2CO_3$) |
| 30% | Sodium tripolyphosphate |

was extruded from an extruder at a temperature of about 55° C. forming a solid block detergent having a mass of about 3.0 kilograms. The extruder had 2 ingredient ports. In the first port, the dry ingredients including the anhydrous sodium carbonate, the ABIL surfactant, sodium tripolyphosphate, the amino triethylene phosphonic acid sequestrants and ⅔ of the nonionic defoamer material were introduced. In port 2, the liquid ingredients including water, the nonionic, and ⅓ of the nonionic defoamer composition were added. The extruder blended the components into a uniform mass. After exiting the machine the blended mass hardened into a solid block detergent.

EXAMPLE II

| | |
|---|---|
| 3.208% | Water |
| 2% | A Benzyl capped, linear $C_{10-14}$ alcohol 12.4 mole ethoxylate |
| 2% | PLURAFAC ® RA-40 |
| 0.5% | Silicone (SILWET ® L-7602) |
| 1.572% | Defoamer |
| 4.390% | 2-phosphono-butane 1,2,4-tricarboxylic acid |
| 3.250% | NaOH, 50% |
| 43.28% | Sodium Carbonate (anhy.) |
| 33.5% | Sodium tripolyphosphate |
| 6.3% | hydroxy propylcellulose-coated (10%) chlorinated isocyanaurate encapsulate |

Example I was made as a cast solid. Example II and each of the detergents in Table 1 were prepared as a solid block as a prototype by combining the ingredients in the dishwasher without forming a solid. This method simulates the dispensing of a cast solid into the dish machine. The formulation in Example I was used as a basis for the prototypes in Table 1. Example I was repeated as a Prototype I. Prototype II was made by increasing the concentration of the Table 1 listed surfactants. Prototype III was developed by substituting the listed surfactants for the surfactants at the concentration listed in Prototype I, etc. Each test sample was prepared by adding a measured quantity of either the solid block or each individual ingredient to a measured quantity of water in the test wash tank to model a cleaning solution derived from contacting a formulated detergent of the invention with water.

The soil removal properties of a blend of a first nonionic surfactant and a second nonionic silicone containing surfactant were measured using solid block materials and prototype detergent solutions prepared as shown in Examples I and II. The block detergents and the prototype solutions were used in cleaning ware containing lipstick soil. The test was conducted using the following protocol.

Test Procedures

A 10-cycle spot, film, protein, and lipstick removal test was used to compare formulas 1 and 2 and other similar formulae under different test conditions. In this test procedure, clean, clean-lipstick stained and milk-coated, Libbey glasses were washed in an institutional dish machine (a Hobart C-44) together with a lab soil and the test detergent formula. Milk coating were created by dipping clean glasses in whole milk and conditioning the glasses for an hour at 100° F. and 65% RH. The concentrations of each detergent were maintained constant throughout the 10-cycle test.

The lab soil used is a 50/50 combination of beef stew and hot point soil. The hot point soil is a greasy, hydrophobic soil made of 4 parts Blue Bonnet all vegetable margarine and 1 part Carnation Instant Non-Fat milk powder.

In the test, the milk-coated, stained glasses are used to test the soil removal ability of the detergent formula, while the initially clean glasses are used to test the anti-redeposition ability of the detergent formula. At the end of the test, the glasses are rated for spots, film, protein, and lipstick removal. The rating scale is from 1 to 5 with 1 being the best and 5 being the worst results.

The data produced by this experiment is displayed below in Table 1. In the table, surfactants in the detergent formula at particular use concentrations and soil load were tested for surface tension at room temperature and 160° F. and lipstick removal protocols using a one cycle and a two to ten cycle test sequence.

TABLE 1

Correlation of Surface Tension Results to 10-Cycle Warewash Test Results

| Prototype Based on Example I | Surfactants used in Detergent Formula from Example II | Detergent Conc., ppm | Total Surfactant Conc., ppm | Soil Load, ppm | Surface Tension at RT, dynes/cm | Surface Tension at 160° F., dynes/cm | Lipstick** Cycle 2–10 | Lipstick** Cycle 1 |
|---|---|---|---|---|---|---|---|---|
| I | 2.5% LF-428<br>0.5% Abil B 8852 | 800 | 24 | 2000 | 33.14 | 26.11 | 1 | 1 |
| | 2.5% LF-428<br>0.5% Abil B 8852 | 1000 | 30 | 2000 | 32.60 | 25.69 | 1 | 1 |
| II | 2% LF-428<br>2% RA-40<br>0.5% SILWET ® L-7602 | 800 | 36 | 2000 | 30.81 | 30.76* | 5 | 5 |
| III | 2% LF-428<br>2% RA-40<br>0.5% Abil B 8852 | 800 | 36 | 2000 | 30.76 | 29.95 | 1 | 1 |
| IV | 2% LF-428<br>2% RA-40<br>0.5% Abil B 8847 | 800 | 36 | 2000 | 31.70 | 30.26 | 1 | 1 |
| V | 0.875% FC-170-C<br>1.313% SILWET ® L-77 | 800 | 17.5 | 2000 | <20 | <20 | 1 | 1 |
| VI | 0.5% Tegopren 5840<br>2.5% Tegin L-90 | 800 | 24 | 2000 | 30.6 | 26.5 | 1 | 1 |
| VII | 2% LF-428<br>2% RA-40<br>1.2% MT-70 | 800 | 41.6 | 2000 | 31.8 | 28.5 | 2 | 1 |
| VIII | 1.2% MT-70 | 800 | 9.6 | 2000 | 27.0 | 24.0 | 1 | 2 |
| IX | 2% LF-428<br>2% RA-40<br>0.6% MT-70<br>0.6% JAQ Quat | 800 | 41.6 | 2000 | 31.0 | 29.2 | 1 | 2.5 |
| X | 2% LF-428<br>2% RA-40<br>0.5% SILWET ® L-7210 | 800 | 36 | 2000 | 31.36 | 30.98* | 1.3 | 1 |
| XI | 0.5% Tegopren 5840 | 800 | 4 | 2000 | 34.5 | 28.7 | 2.5 | 1 |
| XII | 0.5% Tegopren 5840<br>2.5% Triton CF-21 | 800 | 24 | 2000 | 29.8 | 26.3 | 1.3 | 1.5 |
| XIII | 0.5% Tegopren 5840<br>2.5% Triton CF-54 | 800 | 24 | 2000 | 31.2 | 27.1 | 2.25 | 1 |
| XIV | 2% LF-428<br>2% RA-40<br>0.5% Abil B 8878 | 800 | 36 | 2000 | 32.27 | 30.81* | 1.5 | 4 |
| XV | 3.5% LF-428 | 1000 | 35 | 2000 | 32.85 | 32.73 | 3.75 | 3.75 |
| XVI | 2% LF-428<br>2% RA-40<br>0.583% LP-300 | 800 | 36.7 | 2000 | 32.0 | 30.37 | 3 | 3 |
| XVII | 1.75% LF-428<br>1.75% RA-40 | 1000 | 35 | 2000 | 31.61 | 34 | 5 | 5 |
| XVIII | 2% LF-428<br>2% RA-40<br>0.5% Abil B 8873 | 800 | 36 | 2000 | 30.22 | 29.73* | 4 | 5 |

*The Wilhelmy plate became hydrophobicized after the surface tension measurements. Some data are deemed unreliable.

**A grading of 1 means no lipstick remains, a grading of 5 means 100% remains.

Descriptions of the Surfactants Used and Their Manufacturers

LF-428: Benzyl ether of a $C_{10-14}$ linear alcohol 12.4 mole ethoxylate (Ecolab); Plurafac RA-40: Modified ethoxylated straight chain alcohol (BASF Corp.); Surfadone LP-300: N-dodecyl pyrrolidone (International Specialty Products); Monawet MT-70: Di-tridecyl sodium sulfosuccinate, 70% (Mona Industries Inc.); JAQ Quat: N-alkyl (3% $C_{12}$, 95% $C_{14}$, 2% $C_{16}$) dimethyl benzyl ammonium chloride dihydrate (Huntington); Abil B 8852, 8847, 8878, 8873; Tegopren 5840: Polysiloxane polyether copolymers (Goldschmidt Chemical Corporation); Silwet L-7602, L-7210, L-77: Polyalkylene oxide-modified dimethylpolysiloxanes (Union Carbide Corporation); Triton CF-21: Alkylaryl polyether (Union Carbide Corporation); Triton CF-54: Modified polyethoxy adduct (Union Carbide Corporation); Fluorad FC-170–C: Fluorinated alkyl polyoxyethylene ethanols (3M Company) Tegin L-90: Glyceryl monolaurate (Goldschmidt Chemical Corporation)

Table 1 indicates a rough correlation between a low surface tension and improved waxy soil cleaning properties. We have found that when the surfactant blend achieves a surface tension that measures less than about 30 dynes/cm at 160° F., and that the surfactant blend in an alkaline detergent block can remove lipstick soil with other soils without redeposition in a single cycle.

The foregoing specification, examples and data provide a sound basis for understanding the technical advantages of the invention. However, since the invention can comprise a variety of embodiments, the invention resides in the claims hereinafter appended.

We claim:

1. An alkaline metal carbonate detergent composition comprising:

(a) an effective soil removing amount of a nonionic surfactant blend comprising:
  (i) a nonionic surfactant; and
  (ii) a nonionic silicone surfactant comprising a hydrophobic silicone group and a pendent hydrophilic polyalkylene oxide group;

(b) an effective chelating amount of aminocarboxylic acid or salt of aminocarboxylic acid;

(c) an effective amount of a binding agent to provide the detergent composition as a solid, wherein the binding agent comprises a complex of an organic phosphonate compound, sodium carbonate, and water; and (d) wherein the detergent composition includes an effective soil removing amount of a source of alkalinity to provide the detergent composition with a pH of at least 10.0 when provided as a 1 wt. % aqueous solution.

2. An alkaline metal carbonate detergent composition according to claim 1, wherein the source of alkalinity further comprises alkali metal silicate.

3. An alkaline metal carbonate detergent composition according to claim 1, wherein the source of alkalinity comprises alkali metal hydroxide.

4. An alkaline metal carbonate detergent composition according to claim 1, wherein the source of alkalinity comprises sodium carbonate.

5. A An alkaline metal carbonate detergent composition according to claim 1, wherein the composition comprises about 5 wt. % to about 35 wt. % of the binding agent.

6. An alkaline metal carbonate detergent composition according to claim 1, wherein the composition comprises about 10 wt. % to about 25 wt. % of the binding agent.

7. An alkaline metal carbonate detergent composition according to claim 1, wherein the composition comprises about 15 wt. % to about 20 wt. % of the binding agent.

8. An alkaline metal carbonate detergent composition according to claim 1, wherein the nonionic surfactant comprises a polyethylene oxide condensate of alkyl phenol.

9. An alkaline metal carbonate detergent composition according to claim 8, wherein the polyethylene oxide condensate of alkyl phenol has an alkyl group containing about 6 to about 12 carbon atoms and 5 to 20 moles of ethylene oxide per mole of alkyl phenol.

10. An alkaline metal carbonate detergent composition according to claim 1, wherein the nonionic surfactant comprises a condensation product of aliphatic alcohol and ethylene oxide wherein the aliphatic alcohol comprises an alkyl chain containing about 3 to about 22 carbon atoms.

11. An alkaline metal carbonate detergent composition according to claim 1, wherein the nomonic surfactant comprises a condensation product of ethylene oxide with a hydrophobic base formed by condensation of propylene oxide and propylene glycol.

12. An alkaline metal carbonate detergent composition according to claim 1, wherein the nonionic surfactant comprises a condensation product of ethylene oxide and a product resulting from a reaction of propylene oxide and ethylene diamine.

13. An alkaline metal carbonate detergent composition according to claim 1, further comprising at least one of linear alkyl benzene sulfonate surfactant, alcohol sulfate, alcohol ether sulfate, and alpha olefin sulfonate.

14. An alkaline metal carbonate detergent composition according to claim 1, further comprising an amphoteric surfactant.

15. An alkaline metal carbonate detergent composition according to claim 1, further comprising at least one of stearic monoethanolamide, lauric diethanolamide, and stearic diethanolamide.

16. An alkaline metal carbonate detergent composition according to claim 1, further comprising at least one of nonylphenol ethoxylate, linear alkyl alcohol ethoxylate, and ethylene oxide/propylene oxide block copolymer.

17. An alkaline metal carbonate detergent composition according to claim 1, further comprising a nonionic surfactant that is solid at room temperature.

18. An alkaline metal carbonate detergent composition according to claim 1, further comprising a coupler comprising at least one of propylene glycol and polyethylene glycol.

19. An alkaline metal carbonate detergent composition according to claim 1, further comprising urea.

20. An alkaline metal carbonate detergent composition according to claim 1, further comprising a starch that has been made water soluble through an acid or alkaline treatment.

21. An alkaline metal carbonate detergent composition according to claim 1, further comprising at least one of calcium carbonate, sodium sulfate, sodium bisulfate, alkali metal phosphates, and anhydrous sodium acetate.

22. An alkaline metal carbonate detergent composition according to claim 1, further comprising a bleaching source.

23. An alkaline metal carbonate detergent composition according to claim 22, wherein the bleaching source comprises at least one of hypochlorites, chlorites, chlorinated phosphates, chloroisocyanates, chloroamines, and peroxide compounds.

24. An alkaline metal carbonate detergent composition according to claim 1, wherein the aminocarboxylic acid or salt of aminocarboxylic acid comprises an acid or salt of at least one of N-hydroxyethyliminodiacetic acid, nitrilotriacetic acid, ethylenediaminetetraacetic acid, N-hydroxyethylethylenediaminetriacetic acid, and diethylenetriaminepentaacetic acid.

25. An alkaline metal carbonate detergent composition according to claim 1, wherein the composition comprises about 1 wt. % to about 50 wt. % of the aminocarboxylic acid or salt of aminocarboxylic acid.

26. An alkaline metal carbonate detergent composition according to claim 1, wherein the composition comprises about 3 wt. % to about 40 wt. % of the aminocarboxylic acid or salt of aminocarboxylic acid.

* * * * *